United States Patent [19]

Idland

[11] Patent Number: 4,784,077

[45] Date of Patent: Nov. 15, 1988

[54] MOORING DEVICE

[76] Inventor: Kristoffer Idland, P.O. Box 639, Krossen, N-4391 Sandnes, Norway

[21] Appl. No.: 16,558

[22] Filed: Feb. 19, 1987

[30] Foreign Application Priority Data

Feb. 20, 1986 [NO] Norway ..... 860635

[51] Int. Cl.[4] ..... B63B 21/00

[52] U.S. Cl. ..... 114/219; 114/230; 114/251

[58] Field of Search ..... 114/44, 267, 218–220, 114/230, 249, 257, 248

[56] References Cited

U.S. PATENT DOCUMENTS

| | | | |
|---|---|---|---|
| 3,109,404 | 11/1963 | Hartel | 114/219 |
| 3,404,534 | 10/1968 | Runney | 114/219 |
| 3,406,523 | 10/1968 | Bauer | 114/219 |
| 3,600,896 | 8/1971 | Tateisi | 114/219 |
| 3,815,539 | 6/1974 | Stevens | 114/248 |
| 3,890,916 | 6/1975 | Tummers | 114/219 |
| 3,935,831 | 2/1976 | Yamaguchi | 114/248 |
| 4,000,714 | 1/1977 | Colin | 114/248 |
| 4,168,672 | 9/1979 | Fletcher | 114/251 |
| 4,258,641 | 3/1981 | Wakamiya | 114/219 |
| 4,408,556 | 10/1983 | Van der Wiel | 114/219 |

*Primary Examiner*—Joseph F. Peters, Jr.
*Assistant Examiner*—Clifford T. Bartz
*Attorney, Agent, or Firm*—Foley & Lardner, Schwartz, Jeffery, Schwaab, Mack, Blumenthal & Evans

[57] ABSTRACT

A mooring device for barges includes elastic mooring bodies attached to the barges. The elastic bodies are hollow and are adapted for the accommodation of conduits for the transfer of oil, water, electricity, etc., between the barges.

11 Claims, 3 Drawing Sheets

MOORING DEVICE

BACKGROUND OF THE INVENTION

1. Field of the Invention

This invention relates to a mooring device, particularly for mooring of barges to each other.

2. Related Art

Barges are usually moored to each other by means of chain or hawsers which are stretched from one barge to the other. In order that the barges do not strike against each other in heavy sea, etc., the mooring sides of the barges should be equipped with fenders. The barges may be moored closely to each other, as they in heavy sea must have the opportunity of moving in relation to each other. Because of the way of mooring barges, these will constantly be moving away and towards each other with large power, such that pressure propagations in the barges and large strain on the mooring fastenings arise.

In case e.g. oil, water, electricity, etc., shall be transferred between the barges, such transfer is effected in that the necessary conduits are stretched from the deck of one barge to that of the other. Between the barges there may thus be located a large number of conduits, which require considerable time to connect and which take up space on deck.

Especially when mooring barges to each other when the barges are of the type whereupon are placed housing quarters, a hospital, an office, etc., it is important that the barges are moored to each other in a manner that does not allow for pulling and impacts. Moreover, in mooring of such barges to each other it is of great importance to be able to transfer oil, water, electricity, etc., in a simple manner.

SUMMARY OF THE INVENTION

The object of the invention is to provide a mooring device, particularly for mooring of barges to each other, wherein the barges in a quick and simple way can be movably moored to each other without the use of chain and hawsers, and wherein one can transfer oil, water, electricity, etc., in a simple way between the barges.

A mooring device for barges includes elastic mooring bodies attached to the barges. The elastic bodies are hollow and are adapted for the accommodation of conduits for the transfer of oil, water, electricity, etc., between the barges.

BRIEF DESCRIPTION OF THE DRAWINGS

An embodiment of the invention is shown in the drawings, wherein.

DETAILED DESCRIPTION OF THE INVENTION

Figure 1:
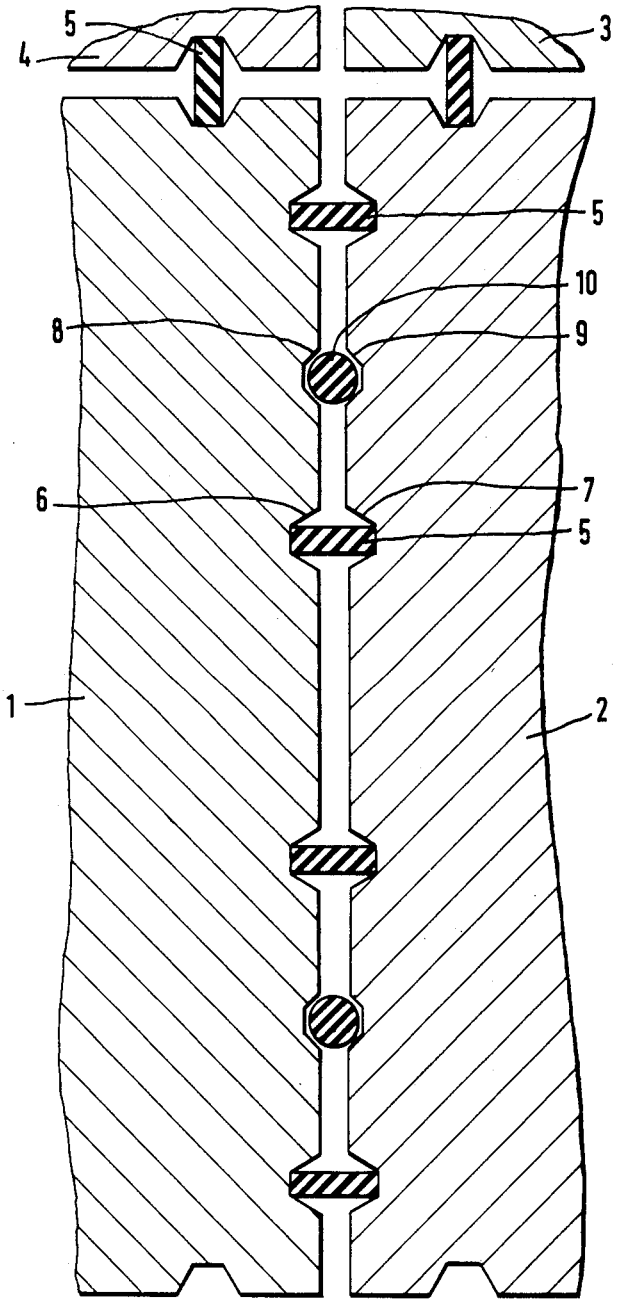
FIG. 1 is a top view in section of parts of four barges which are moored to each other.

In the drawing, reference numerals 1, 2, 3 and 4 indicate barges which are moored to each other by means of elastic mooring bodies 5, preferably of reinforced rubber. In order to allow for necessary torsion and mutual displacement of height of the barges, the mooring bodies 5 are placed in conical openings 6, 7 in the side portion of the barges. To counteract substantial mutual displacement between the barges in the horizontal plane, opposing cavities 8, 9 are provided in the sides of the barges, in order to accomodate circular fenders 10. At displacement of the barges in the direction transversely of the mooring bodies 5, the fenders 10 after a relative small displacement will cause the barges to be displaced in the direction longitudinally of the mooring bodies 5. Such displacement change is obtained in that the fenders 10 have such a circumference that they entirely or at least substantially fill the spaces formed by the opposing cavities 8 and 9.

Figure 2:
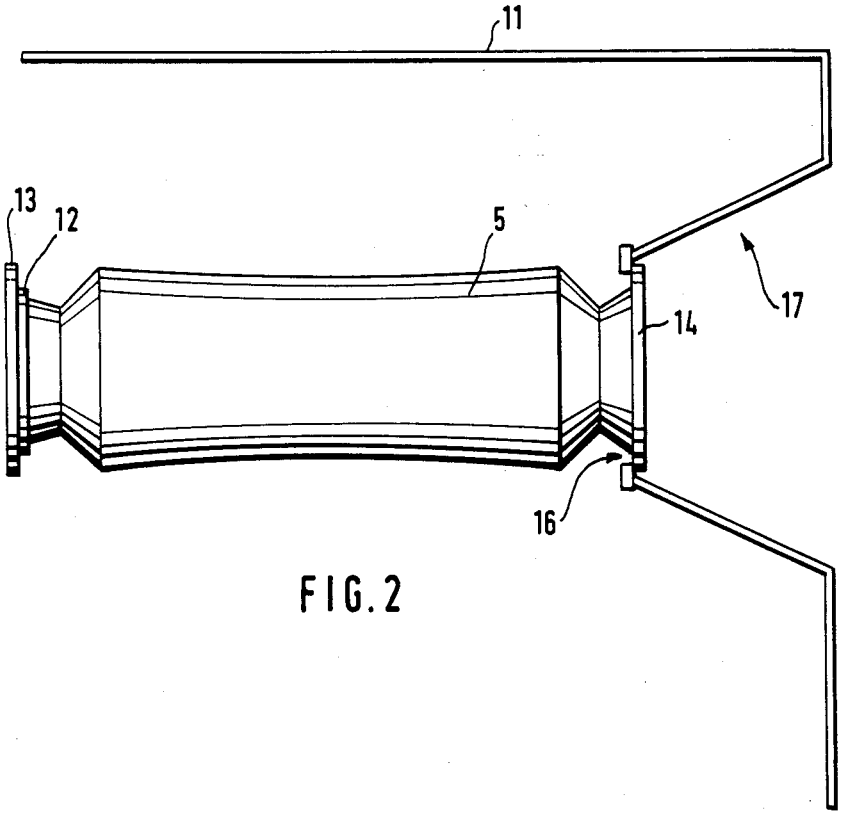
FIG. 2 shows a mooring device according to the invention in an inactive position withdrawn into a barge.

The reference numeral 11 in FIG. 2 indicates a part of the deck of the barge 1 whereunder elastic mooring bodies 5 in the inactive position are placed. The mooring body 5 is withdrawn into the barge and supported in known, but not shown, manner.

The elastic mooring body 5 is provided at the rear end thereof with a flange 12 and a flange plate 13, while it at the forward end is provided with a flange 14. The diameter of the flange 14 is larger than an opening 16 wherethrough the mooring body 5 in known manner can be pulled, and the opening 16 is located in the bottom of a conical portion 17 in the side of the barge 1.

Figure 3:
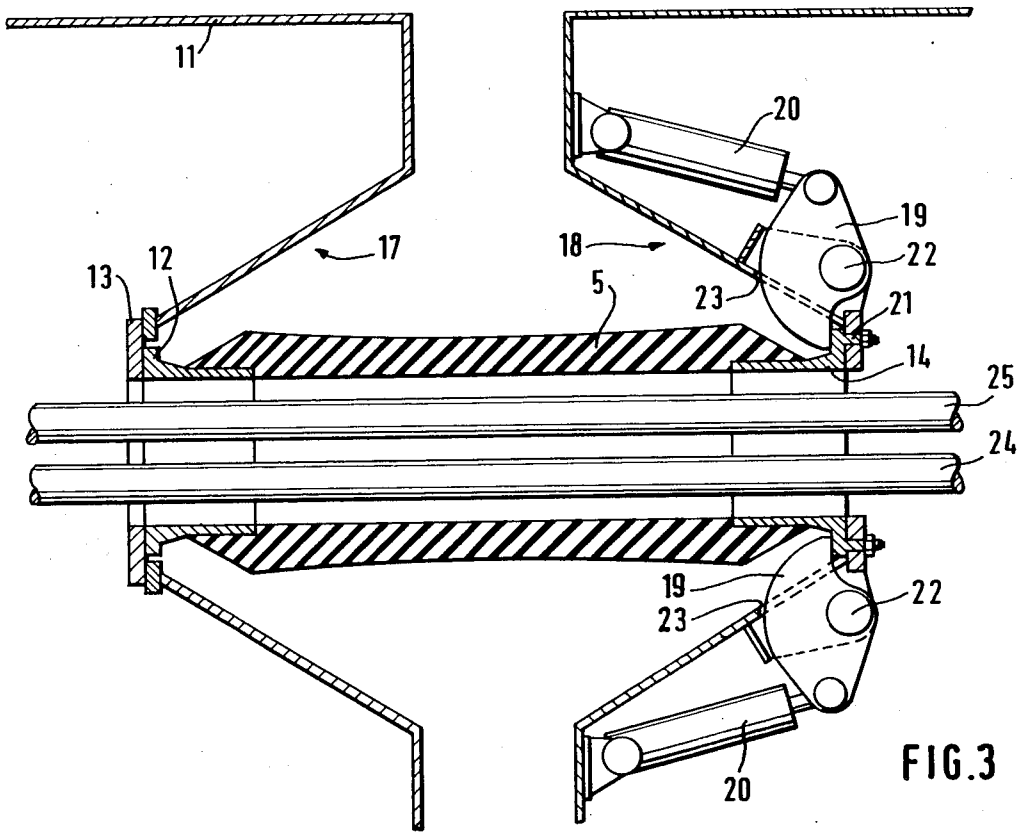
FIG. 3 shows the same mooring device in an active position between two barges.

When two or more barges 1, 2 are to be moored to each other, the barges are positioned such that the side of one barge provided with extractable elastic mooring bodies 5 corresponds to the side of a barge having corresponding conical portions 18 without mooring bodies 5. (See FIG. 3) That barge that is not, or only partly, provided with mooring bodies 5, may be a so-called main barge wherein necessary machinery, tanks, etc., for the supply of oil, water, current, etc. to the adjacent barges, are located. When the barges are sufficiently close to each other, the mooring bodies 5 in known manner are extracted from the barge 1 and into the portion 18 in the barge 2 until cam discs 19 by means of hydraulic cylinders 20 engage the flange 14 and lock it in place. The cam discs 19 are supported 22 within the barge 2 and can be pushed out through an opening 23.

Centrally within the mooring body 5 are placed conduits 24, 25 which in known manner can be connected to corresponding conduits located within the barge 2. When the barges not are connected, the openings in the conical portions 17, 18 may be covered in known manner, e.g. in that plates are placed and attached over the openings.

When the barges are to be disconnected, the same procedure as above, but in the reverse order, is used.

By using a mooring device according to the invention, one will have a strong and flexible mooring simultaneously as one avoids strong pulls and throws between the barges as the result of wind or wave movements. Further, one achieves that oil, water, current, etc., in a very simple way can be transported from one barge to another.

I claim:

1. A mooring device, particularly for the mooring of a pair of adjacent barges to each other, comprising:

(a) at least one cavity in each barge, said cavities being complementary and forming a pair of complementary cavities, (b) an elastic mooring body in each pair of complementary cavities, said mooring body having a pair of ends and a flange on each end, (c) each of said cavities having an opening thereof, and (d) each of said flanges cooperating with a respective opening for retaining said mooring body in said complementary pair of cavities.

2. A mooring device as defined in claim 1 wherein the elastic mooring body is hollow and adapted to accommodate conduits for the transportation of oil, water, electricity between the barges.

3. The mooring device as claimed in claim 1, including an opening in each cavity, means for restraining an end of the elastic mooring body in the opening while pushing the body into a complementary cavity.

4. A mooring device, particularly for the mooring of a pair of adjacent barges to each other, comprising:

(a) at least one cavity in each barge, said cavities being complementary and forming a pair of complementary cavities, (b) an elastic mooring body in each pair of complementary cavities, (c) said mooring body having a pair of ends and a flange on each end, (d) one of said flanges resting against an inner portion of one cavity and the other flange attached to the other cavity by means of cam discs engaging the other flanges.

5. A mooring device as defined in claim 4 wherein the cam discs are adapted to be rotated by hydraulic cylinders.

6. A mooring device as defined in claim 1 wherein additional cavities are provided in the barge, said cavities being adapted to be positioned opposite opposing cavities in a moored adjacent barge, in order to form a space for the accommodation of fenders.

7. A method of mooring a pair of adjacent barges, comprising:

(a) providing at least one cavity in each barge, thus forming a pair of substantially complementary cavities in adjacent barges, (b) inserting an elastic mooring body in each pair of said complementary cavities, (c) restraining one end of the mooring body by a first flange cooperating with an opening for one barge, and engaging a second flange on another end of the mooring body by pivotally rotating a pair of cam discs into engagement with the second flange.

8. A method of mooring a pair of adjacent barges, comprising:

(a) providing at least one cavity in each barge, thus forming a pair of substantially complementary cavities in adjacent barges, (b) forming an opening in each of said cavities, (c) inserting an elastic mooring body having a pair of ends and a flange on each end in each pair of said complementary cavities, and (d) extending one of the flanges through one of the openings and retaining the mooring body in the cooperating pair of cavities.

9. The method of mooring barges as claimed in claim 8, including providing additional complementary cavities and inserting mooring bodies therein.

10. The method of mooring barges as claimed in claim 8, including pushing said bodies from cavities in one barge into cavities in the adjacent barge.

11. The method of mooring barges as claimed in claim 8, including forming said bodies with an opening therethrough and passing conduits through said openings for the transfer of oil, water, electricity between adjacent barges.

* * * * *